US011517056B2

(12) United States Patent
Hall et al.

(10) Patent No.: US 11,517,056 B2
(45) Date of Patent: Dec. 6, 2022

(54) TWIN SEAM PANEL TROUSERS

(71) Applicants: Jeffrey Hall, Columbia, TN (US); William Tisano, Brentwood, TN (US)

(72) Inventors: Jeffrey Hall, Columbia, TN (US); William Tisano, Brentwood, TN (US)

( * ) Notice: Subject to any disclaimer, the term of this patent is extended or adjusted under 35 U.S.C. 154(b) by 0 days.

(21) Appl. No.: 15/634,157

(22) Filed: Jun. 27, 2017

(65) Prior Publication Data

US 2018/0368487 A1 Dec. 27, 2018

(51) Int. Cl.
*A41D 1/06* (2006.01)
*A41D 27/24* (2006.01)

(52) U.S. Cl.
CPC ..... *A41D 1/06* (2013.01); *A41D 27/24* (2013.01)

(58) Field of Classification Search
CPC ..... A41D 1/06; A41D 1/088; A41D 1/086; A41D 1/083; A41D 1/082; A41D 1/08; A41D 27/24; A41D 2300/20; A41D 2300/22
USPC ..... 2/227, 228, 78.3, 79; D2/731, 742
See application file for complete search history.

(56) References Cited

U.S. PATENT DOCUMENTS 2,318,199 A 5/1943 Clements
2,816,361 A * 12/1957 Jobst ..... A61F 13/08 602/75
3,392,733 A * 7/1968 Blair ..... A41C 1/003 450/104
4,015,318 A 4/1977 Hakanson
4,261,060 A 4/1981 Zawacki
4,371,989 A 2/1983 Polsky
4,488,317 A * 12/1984 Polsky ..... A41D 1/06 2/227
4,670,913 A * 6/1987 Morell ..... A41D 13/02 2/227
4,785,480 A * 11/1988 Polsky ..... A41D 1/06 2/227
4,843,654 A * 7/1989 March ..... A41D 1/086 2/227
5,008,962 A * 4/1991 Smith ..... A41D 1/06 2/227

(Continued)

FOREIGN PATENT DOCUMENTS

JP 11001804 A 1/1999

OTHER PUBLICATIONS

International Search Report and Written Opinion dated Jan. 24, 2014 for PCT Application No. PCT/US2013/072180.

(Continued)

*Primary Examiner* — Heather Mangine
(74) *Attorney, Agent, or Firm* — Nelson Mullins Riley & Scarborough LLP

(57) ABSTRACT

The present invention is trousers that include an inseam panel insert that may be continuous across the crotch and down the inside longitudinal lines of the legs, preventing the need for an actual seam on the inseam of the trousers. The inseam panel insert is connected to the other fabric of the trousers with seams that are disposed away from the traditional inseam location and away from the crotch area. The inseam panel insert has at least one area, and typically two or more, which has an increased, progressively increasing and progressively decreasing width, located between the crotch area and the end of the pant leg. The trousers allow increased flexibility, particularly in the seated position.

12 Claims, 4 Drawing Sheets

(56) References Cited

U.S. PATENT DOCUMENTS 5,033,123 A * 7/1991 Audet ..... A41D 1/06 2/227
D319,525 S 9/1991 Clark
5,046,194 A 9/1991 Alaniz et al.
D483,924 S * 12/2003 Morisset ..... D2/742
7,500,274 B1 * 3/2009 Kallen ..... A41D 1/086 2/227
7,512,995 B2 4/2009 Deffner
7,814,576 B2 * 10/2010 Nakazawa ..... A41D 31/18 2/227
7,849,522 B2 * 12/2010 Roux ..... A41D 1/089 2/227
D663,923 S * 7/2012 Karik ..... D2/742
D664,737 S * 8/2012 Slank ..... D2/742
8,402,565 B1 * 3/2013 Penner ..... A41D 13/1254 2/227
D693,989 S * 11/2013 Tanaka ..... D2/742
D698,520 S * 2/2014 Anderson ..... D2/742
D705,519 S * 5/2014 Meyer ..... D2/742
D748,373 S * 2/2016 Darmour ..... D2/742
D775,785 S * 1/2017 Darmour ..... D2/731
D777,404 S * 1/2017 Lomax ..... D2/742
D796,785 S * 9/2017 Suarez ..... D2/742
2003/0101506 A1 * 6/2003 Fujii ..... A41D 13/0015 2/240
2005/0166298 A1 * 8/2005 Pieroranzio ..... A41D 1/06 2/69
2006/0230488 A1 * 10/2006 Rudolph ..... A41D 1/086 2/69
2007/0074333 A1 * 4/2007 Heatherington ..... A41D 1/06 2/227
2009/0007311 A1 * 1/2009 Semba ..... A41D 1/08 2/69
2009/0139015 A1 * 6/2009 Meyer ..... A41D 1/067 2/455
2009/0151038 A1 * 6/2009 Muench ..... A41D 1/086 2/23
2010/0004563 A1 * 1/2010 Lipshaw ..... A61F 13/08 600/587
2010/0186148 A1 * 7/2010 Crockett ..... A41D 1/08 2/227
2010/0299804 A1 * 12/2010 Huang ..... A41D 1/06 2/93
2011/0010820 A1 * 1/2011 Harding ..... A41D 13/1254 2/115
2011/0099680 A1 * 5/2011 Gordon ..... A41D 27/28 2/79
2011/0296587 A1 * 12/2011 Davis ..... A41D 1/06 2/239
2013/0014311 A1 * 1/2013 Chapuis ..... A41D 1/08 2/69
2014/0150166 A1 * 6/2014 Hall ..... A41D 1/06 2/227
2014/0230124 A1 * 8/2014 Wilms-Otto ..... A41D 31/18 2/69
2015/0231483 A1 * 8/2015 Rudow ..... A63B 71/1225 2/24
2016/0050985 A1 2/2016 North et al.
2016/0058077 A1 * 3/2016 Moore ..... A41D 1/086 2/227
2016/0120246 A1 5/2016 Boyle et al.
2017/0266537 A1 * 9/2017 Zakem ..... A41B 9/12
2017/0290382 A1 * 10/2017 Arnold ..... A41D 1/04
2018/0279693 A1 * 10/2018 Wipranik ..... A41D 1/06
2018/0303179 A1 * 10/2018 Konukoglu ..... A41D 1/06
2018/0368487 A1 * 12/2018 Hall ..... A41D 1/06

OTHER PUBLICATIONS

Search Report and Written Opinion for PCT Application No. PCT/US2018/39773 dated Sep. 20, 2018, 14 pages.

* cited by examiner

TWIN SEAM PANEL TROUSERS

FIELD OF THE INVENTION

The present invention generally relates to trousers, and in particular, trousers with panel inserts.

BACKGROUND OF THE INVENTION

Some of the greatest stress areas in a pair of trousers are in the crotch and the inseams extending down from the crotch.

SUMMARY OF THE INVENTION

According to an aspect of the present invention, a pair of trousers is formed with a continuous panel positioned in the crotch and inseam areas of the trousers, and which is sewn together with the other fabric of the trousers at locations distant from the crotch and traditional inseam locations. The width of the inseam panel insert is less in the crotch area and increases to a larger width at one or more points leading to and/or at the knee areas. In certain embodiments the inseam panel insert is a stretch material with a primary stretch direction extending on a bias to the longitudinal direction of the trouser legs.

The accompanying drawings, which are incorporated in and constitute a part of this specification illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
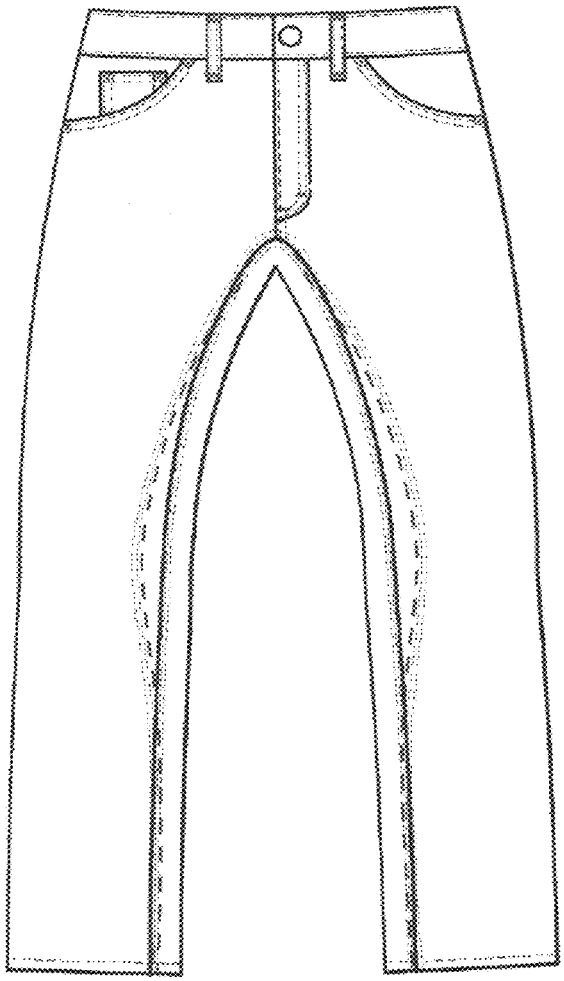
FIG. 1 is a front view of a pair of trousers in accordance with an embodiment of the present invention illustrating both front insert panel seams and rear insert panel seams (the inseam panel insert)

Repeat use of reference characters in the present specification and drawings is intended to represent same or analogous features or elements of the invention.

DETAILED DESCRIPTION OF PREFERRED EMBODIMENTS

Reference will now be made in detail to certain embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. Thus, it is intended that the present invention covers such modifications and variations as come within the scope of the appended claims and their equivalents.

Typically, pants (sometimes known as trousers) will have one left outseam, one right outseam, and one inseam, all of which are comprised of straight or relatively straight edges. Outseams run vertically upward both on right and left side from the bottom edge of each leg along their outside center toward the top of the pant. The inseam runs vertically upward from the bottom edge of right leg along its inside center toward the crotch and continues vertically downward from crotch along the inside center of left leg ending at the bottom left inside edge.

When pants are sewn, single layers of fabric of various sizes and shapes come together by joining, folding and stitching together forming seams. These seams are typically 3- to 4-ply thick and approximately ⅜ inches wide in most designs. Seams, therefore, are more rigid than single layers and stress applied along them produces less stretch, or "give", than the surrounding single layer of fabric from which the seam was made.

Strain as the result of a stress is commonly referred to as elastic stretch when the stretch is reversible. However, if too much stress is applied, elasticity may be lost and yielding begins. At this point, any continued stretching is irreversible and becomes permanent, thus altering a fabric's dimensions and shape. When stress is applied to a pant, it can be demonstrated that seams will have a lower stretch coefficient than the surrounding fabric from which they were made, thus limiting overall elasticity of the pant, particularly along the seams. If a straight seam is made longer by increasing its length, the amount of corresponding elastic strain (i.e., available stretch) as force is applied along it, will be greater than when the seam is made shorter. Likewise, if a single straight seam is replaced by two straight seams of equal length then, as before, when stress is applied along the seams, both seams will stretch the same relative amount. If, on the other hand, a single straight seam is replaced by two seams, one being straight and the other seam having an undulating curvature, the curved seam will be longer in length than that of the straight seam. As a result, when stress is applied along the seams equally, the longer of the two seams—the one with the curvature—will exhibit less resistance to that stress, or more stretch than that of the shorter seam. This differential stretch occurs in the insert seam panel, whereupon the undulating curves on the rear edge of the insert seam panel add length to the rear edge of panel, which as a result, when force is applied longitudinally along the panel insert, the rear panel edge has greater potential for stretching than the front panel edge. This is a term is called "differential stretch" and is a result of the variable shape embodied in the rear edge of the insert panel.

The process used to make seams usually involves sewing two pieces of fabric together by first matching edges, then overlapping them and folding one edge over the other, and stitching both together. In the case of side and inseams, straight edges are generally involved, but in some seams like the front pocket, a curved seam is required. Generally speaking, curved seams require more operator finesse to maintain the two opposing edges feeding equally together through the sewing machine because the two edges must come together as a compound curve requiring constant pivoting of both pieces following their curved edge. The greater the amount of curve involved, the longer it takes to sew. By limiting the front edge of panel insert to a straight, relatively stable seam as in the present invention, an increase in sewing efficiency results.

The design of the inventive trousers having the particular inventive inseam panel insert uses differential seam shapes and lengths to direct and control the stretching in the inseam panel insert generally away from the uniform front edge toward the rear edge where they are both less visible and generally receive higher localized pressures, particularly in the seated position. By allowing the rear curved edge to stretch more than the front, and by allowing the forces at the rear curved edge to occur at differing angles, the overall deflection in the inseam panel insert can be controlled and directed more toward the rear, leaving the front edge more uniform in shape and the rear edge more adaptable to absorbing the localized forces encountered at the rear. The unique rise creep feature of the present invention affects crotch forces in a way heretofore unseen in other pants, including those of the gusseted or multiple inseam variety. The lateral width at the crotch in the present invention directs force away from the crotch with increasing divergence, both outward toward the knees and rearward. An area of "cross force" also exists both through and across the restricted crotch area which acts to improve leg articulation when engaging in high-movement activities such as kicking, lunging, or bending.

Figure 3:
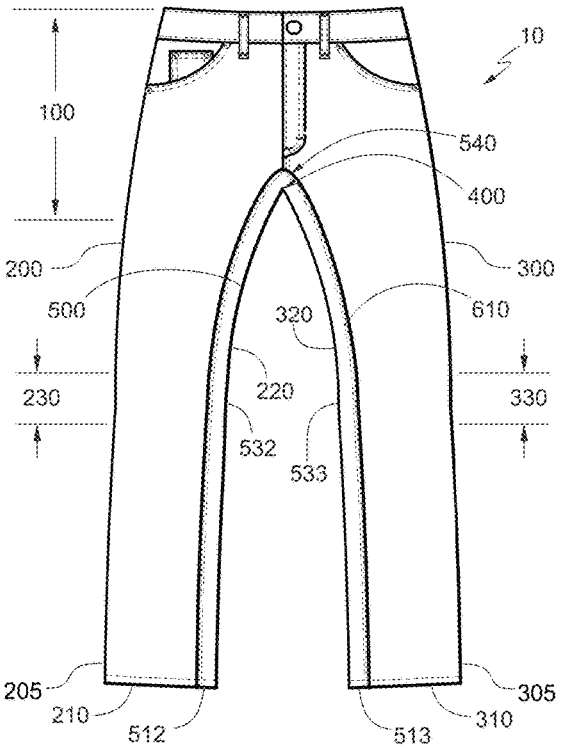
FIG. 3 is a front view of the trousers of FIG. 1 illustrating only the front insert panel seams.
Figure 4:
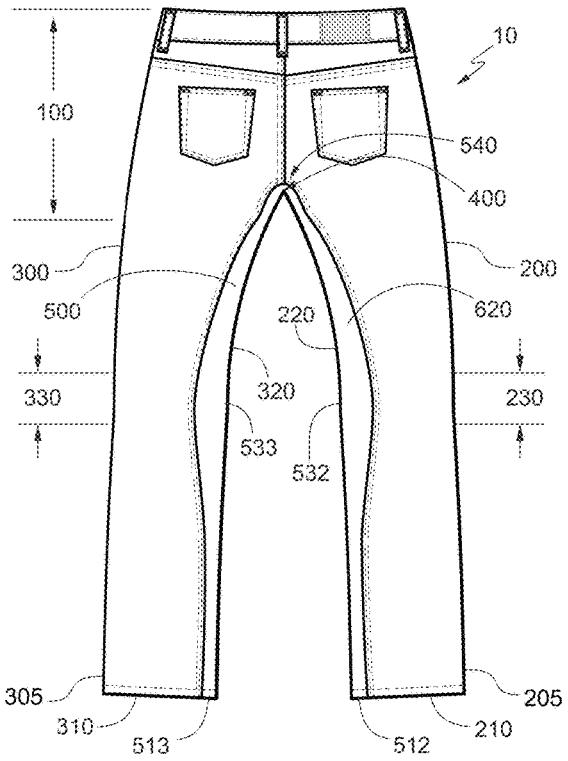
FIG. 4 is a rear view of the trousers of FIG. 1 illustrating only the rear insert panel seams.

As shown in the front views of FIGS. 1 and 3, inventive trousers 10 generally have a torso body 100 with a right leg 200 and a left leg 300 extending from the lower portion of the torso body 100 to right leg bottom 205 and left leg bottom 305. At the intersection of the right leg 200 and the left leg 300 with the torso 100 is the crotch 400. At the end of the right leg 200 is a right cuff 210 extending circumferentially around the right leg 200 at the end of the right leg 200. Similarly, the left leg 300 has a left cuff 310 extending circumferentially around the left leg 300 at the end of the left leg 300. Midway from the right cuff 210 to the crotch 400 in the right leg 200 is the right knee 230. Also, midway from the left cuff 310 to the crotch 400 in the left leg 300 is the left knee 330. A right longitudinal interior line or right inseam line 220 extends longitudinally on inside of the right leg 200 from the right cuff 210 to the crotch 400, and a left longitudinal interior line or left inseam line 320 extends longitudinally on the inside of the left leg 300 from the left cuff to the crotch 400. The right inseam line 220 and the left inseam line 320 are imaginary lines without an actual seam extending in the trousers 10 for these distances.

As illustrated in the figures, trousers 10 are constructed with an inseam panel insert 500. The inseam panel insert 500 is a panel that progresses along the right inseam line 220, through the crotch 400, and along the left inseam line 320. The inseam panel insert 500 extends at least from crotch 400 and down to the right knee 230 and from crotch 400 and down to the left knee 330. Inseam panel insert 500 may also extend from crotch 400 and down to one or both of right cuff 210 or left cuff 310, or down to one or both of right leg bottom 205 or left leg bottom 305. Inseam panel insert 500 may also be continuous through crotch 400 as shown in FIGS. 1 and 3, extending continuously at least from the right knee 230 to the left knee 330 but may also extend down to one or both of right cuff 210 or left cuff 310 (as shown in FIGS. 1 and 3).

The inseam panel insert 500 may be connected within the trousers 10 by an inseam panel insert front seam 610 on the forward side of the trousers 10 and an inseam panel insert rear seam 620 on the rear side of the trousers 10 (as shown in FIGS. 1, 4, 7, and 10), both of which may run continuously from one end of the inseam panel insert 500 to the other. The inseam panel insert front seam 610 may be an overlapping seam with the inseam panel insert 500 overlapping other fabric panels of the trousers 10. The inseam panel insert rear seam 620 may be an overlapping seam with the other panels of the trousers 10 overlapping the inseam panel insert 500. However, other types of seams as known by those of skill in the art may also be utilized in the present invention.

The inseam panel insert front seam 610 and the inseam panel insert rear seam 620 may each be disposed at a distance from the right inseam line 220 and the left inseam line 320, and over the crotch 400. In such a structure, there will be no actual seams located on the right inseam line 220 or the left inseam line 320 that could create rubbing or friction issues, as with ordinary construction trousers. Additionally, the movement of the front inseam panel insert seam 610 and the inseam panel insert rear seam 620 to a position above the crotch 400 creates a trouser where there are no seams joining at the crotch 400, thus reducing any weakness that could be created in the fabric next to the joining of the four seams. In contrast, in traditional trousers, the right inseam, left inseam, front seam and rear seam all join at the high stress area of crotch 400, allowing for weakening of the fabric next to the joining of the four seams.

Figure 5:
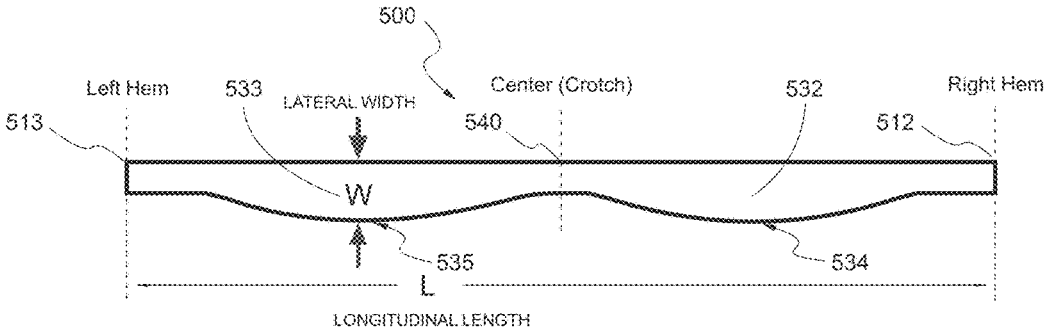
FIG. 5 is a top plan view of the inseam panel insert from the trousers of FIGS. 1, 3, and 4 with the front of the insert for attaching to the front of the trousers shown at the top of the figure and the back of the insert for attaching to the back of the trousers at the bottom of the figure.

Referring to FIG. 5, inseam panel insert 500 has a right cuff end 512, which can be referred to as the right hem and a left cuff end 513 which can be referred to as the left hem, a right knee location 532 (location shown is approximate) and a left knee location 533 (location shown is approximate), and a crotch location 540. In the illustrated embodiment of FIG. 5, inseam panel insert 500 has an increased width portion 534 and an increased width portion 535 wherein the widths of the increased width portion 534 and increased portion 535 are greater than the width of the remainder of the inseam panel insert 500. In general, the width of increased width portion 534 begins increasing progressively at some point spaced from left cuff end 513 to a maximum width and then decreases progressively back to the original width at some point spaced from the crotch 400 and the width of increased width portion 535 begins increasing progressively at some point spaced from right cuff end 512 to a maximum width and then decreases progressively back to the original width at some point spaced from the crotch 400. It is to be understood that the point at which the aforesaid widths begin increasing, begin decreasing, and then return to the original width may vary and may not be uniform between increased width portion 534 and increased width portion 535. In addition, any particular inseam panel insert 500 may employ one of increased width portion 534 or 535, both of increased width portion 534 and 535 or additional increased width portions similar to the progressive width portions shown in FIG. 5.

The lengths of the increased width portions 534 and 535 may vary for different trouser designs and may vary from each other within the same trousers 10, resulting in increased width portions 534 and 535 of different length within the same pair of trousers 10. In the embodiment shown in FIG. 5, however, the length of increased width portion 534 is essentially identical to the length of increased width portion 535. In the embodiment show in FIG. 5, the corresponding widths along the increased width portion 534 are identical to those along the increased width portion 535 at any given corresponding location therewithin. However, it is to be understood, that depending on design features desired, the width at corresponding locations on increased width portion 534 and increased width portion 535 may vary one from the other.

Figure 6:
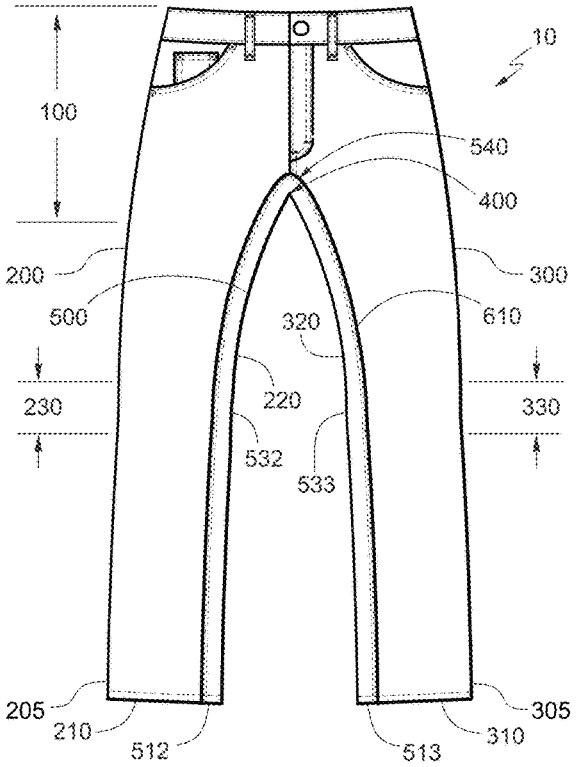
FIG. 6 is a front view of a pair of trousers in accordance with another embodiment of the present invention illustrating only the front insert panel seams.
Figure 7:
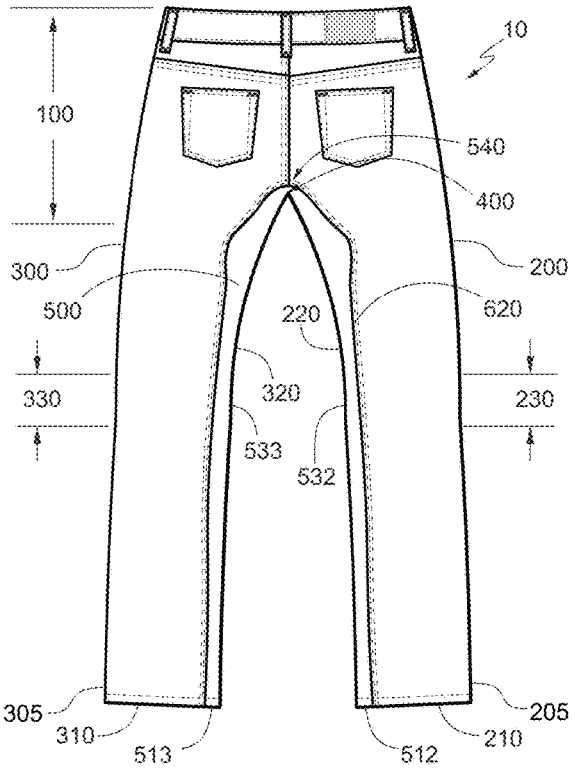
FIG. 7 is a rear view of the trousers of FIG. 6 illustrating only the rear insert panel seams.
Figure 8:
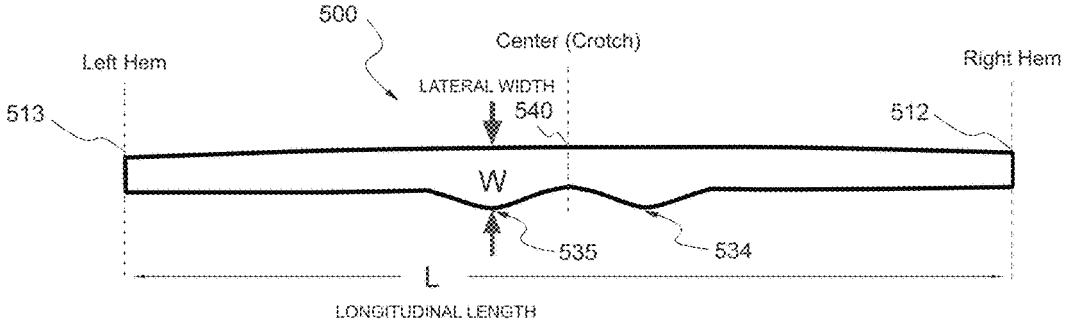
FIG. 8 is a top plan view of the inseam panel insert from the trousers of FIGS. 6 and 7 with the front of the insert for attaching to the front of the trousers shown at the top of the figure and the back of the insert for attaching to the back of the trousers at the bottom of the figure.

Other embodiments of the present invention are shown in FIGS. 6-8 wherein increased width portion 534 and increased width portion 535 of inseam panel insert 500 are not located down the legs near the knees, but are instead located closer to crotch 400.

Figure 9:
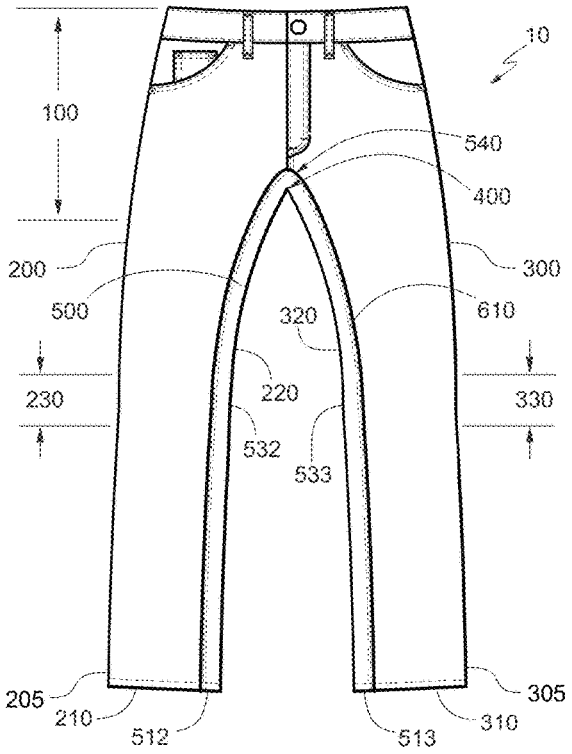
FIG. 9 is a front view of a pair of trousers in accordance with another embodiment of the present invention illustrating only the front insert panel seams.
Figure 10:
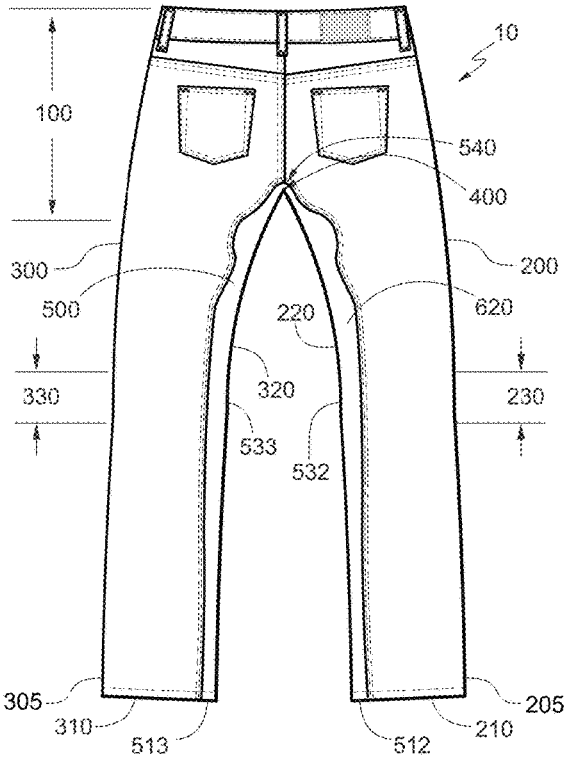
FIG. 10 is a rear view of the trousers of FIG. 9 illustrating only the rear insert panel seams.
Figure 11:
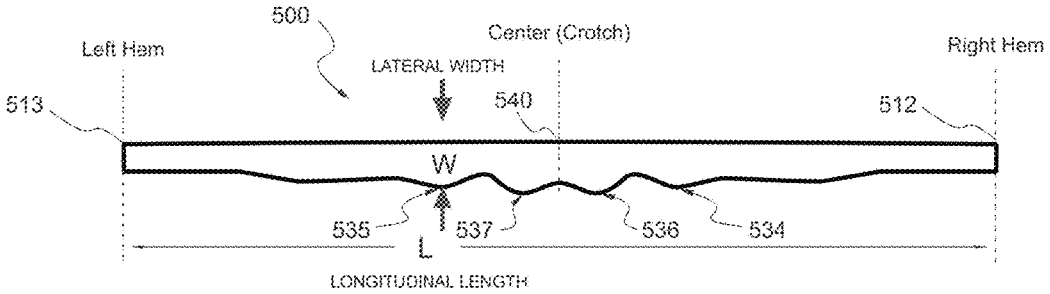
FIG. 11 is a top plan view of the inseam panel insert from the trousers of FIGS. 9 and 10 with the front of the insert for attaching to the front of the trousers shown at the top of the figure and the back of the insert for attaching to the back of the trousers at the bottom of the figure.

Other embodiments of the present invention are shown in FIGS. 9-11 wherein trousers 10 are shown with two distinct increased width portions having different widths but located on each of the right leg 200 and the left leg 300. For example, right leg 200 may have an increased width portion 534 and 536 and left leg 300 may have an increased width portion 535 and 537. While the increased width portions shown in FIGS. 9-11 are illustrated closer to the crotch 400 than to the left and right knees 230 and 330, it is to be understood that the increased width portions may be positioned anywhere from crotch 400 to right cuff end 512 and to left cuff end 513.

In certain embodiments, inseam panel insert 500 may be formed of a stretch or elastic material. A stretch material used in combination with the shape of the inseam panel insert 500 having progressively increasing and progressively decreasing widths provides additional stretch to the trousers 10 in the areas with the most stress from a user, and less stretch in the areas where the user does not need or desire additional stretch.

Trousers of the present invention are particularly useful in the context of jeans and other athletic-type trousers that may be worn by those practicing the martial arts or yoga, where flexibility is particularly important. An objective of the invention may be to be similar in both appearance and feel to that of a typical jean-type pant, but with enhanced flexibility, seating comfort and long term dimensional stability through the crotch area of the trousers.

The invention allows the relief of an amount of stress and discomfort to the wearer particularly when in the seated position. The differential geometry of inseam panel insert 500 with its variable curved shape corresponds generally to the wearer's anatomy. The differential shaping of inseam panel insert 500 as described hereinabove is unique and uncharacteristic of other dual inseam or gusseted designs and results in a distinct loss of insert panel symmetry, such that while left and right inseam panel insert symmetry exists across the lateral axis, front and rear symmetry is lost across the longitudinal axis. In addition, the lengths of the front inside panel edge and the rear inside panel edge are no longer equal, such that the rear undulating curved panel edge is longer. In addition, because the front panel edge is straight and the rear panel edge is curved, the rear panel edge must be longer in length measured longitudinally from left to right.

Figure 2:
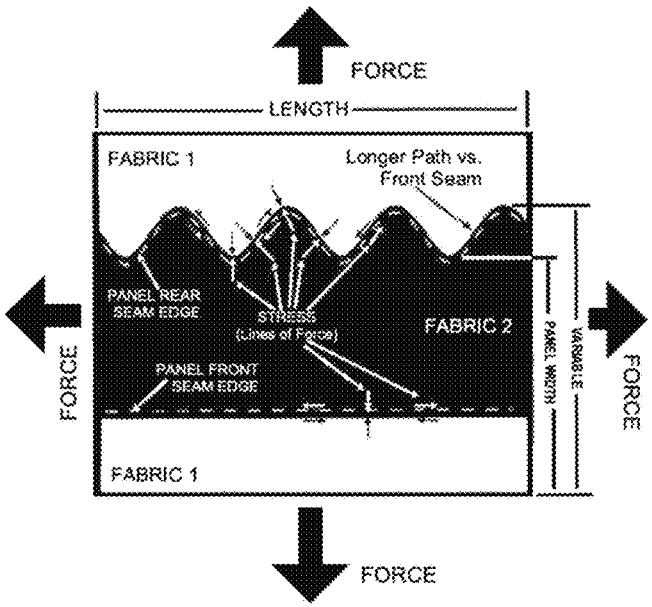
FIG. 2 is a force/stress diagram illustrating the interplay of two fabrics having differing properties in the context of an embodiment of the present invention.

As shown graphically in FIG. 2, the different lengths in each opposing edge of the inseam panel insert 500 creates differential stretching about the panel's width, with less resistance to stress and more range of force absorption at the rear and more stress uniformity at the front. By limiting the front seam to a straight line, the deflection of the insert panel when stretched is relatively uniform longitudinally at its front edge. By allowing the rear seam to curve in an undulating fashion, the deflections from forces along its edge will be variable in both the amount of elongation available, and the direction in which the elongation occurs. The curvature of the rear inner panel edge also creates variations in the distance, measured as width, between the straight front edge and the variable curved rear edge. The variability to the inner panel width arises from the variability in curvature of the rear facing edge of the inner panel, and specifically addresses seating comfort.

As described hereinabove, the inner panel geometry design is expected to alleviate stress in the seated position. By having a straight front panel edge, the forward portion of inseam panel insert 500 will have less tendency to move rearward than the rear portion of inseam panel insert 500, which has the undulating curvature. The curvature creates multiple directions for the forces to disperse, as in stretching askew the seam, increasing longitudinal edge length of the rear seam as well, with both providing greater force distribution relative to the shorter and straighter front edge. These two factors, coupled with any elasticity of the inseam panel insert 500 itself, contribute to the way the panel conforms to the body. This unique conformity can enhance seating comfort in a way that alleviates binding in the crotch or tugging at the hips.

Another characteristic of using the inventive trousers 10 having the described inseam panel insert 500 is the relative reduction of a problem known as "Rise Creep." Rise Creep is known in the industry as the tendency for the rise of a pant (i.e., the total rise from front to rear) to grow longer over time. This undesirable phenomenon arises due to the excess forces beyond the elastic range that are applied along the direction of the front and rear seat seam when the pants are in use. Such conditions are terms "front rise" and "rear rise" and, together, constitute the "total rise." These rises follow a path running from the center of the front waist downward around the crotch and upward again to the center of rear waist.

Known current gussets, as well as other known multiple inseam designs, breech the rise area generally at the crotch-point to insert either a single occluded triangular piece of material, or a generally parallel or continuous longitudinally symmetric piece of material. The present invention differs from these other designs by having the center area of the longitudinal axis of the trousers found at the crotch noticeably narrower than the surrounding widths as the inseam panel insert continues down the legs of the trousers.

Although lateral width restriction may occurs at the crotch, longitudinal stretch restriction is not affected to the same degree is in other designs. The present invention allows "cross stretch" acting diagonally from one leg to the other, and acting through and about a point with a relatively stabilized center point at the crotch, laterally being stabilized dimensionally via the narrowing feature. As such, ample longitudinal stretch with minimal lateral strain variation or "rise creep" in the crotch is noticed.

In another embodiment, the inseam panel insert 500 may be formed of a directional stretch or elastic material. The directional stretch or elastic material has a primary stretch direction which is preferably located on a bias to the longitudinal direction of the inseam panel insert 500 in the trousers 10. During formation of the trousers 10 with the inseam panel insert 500, the sewing of the continuous front inseam panel insert seam 610 and inseam panel insert rear seam 620 can cause the inseam panel insert 500 to stretch in longitudinal length. This longitudinal stretch of the inseam panel insert 500 during formation of the trousers 10 is undesirable as it creates areas of the inseam panel insert 500 with prestretch conditions different in different areas of the trousers 10, and a mismatch of the inseam panel insert 500 length to the legs of the trousers 10. The use of directional stretch or elastic material on a bias has the advantage of inhibiting the longitudinal stretch of the inseam panel insert 500. A preferred bias of the directional stretch in the inseam panel insert 500 is from about thirty degrees (30°) to about sixty degrees (60°) from the longitudinal direction of the inseam panel insert 500, or from about one-hundred twenty degrees (120°) to about one-hundred degrees (150°) from the longitudinal direction of the inseam panel insert 500.

In one preferred embodiment, the trousers 10 are jeans made of denim, and the inseam panel insert 500 is a directional stretch denim with the stretch direction being located forty-five degrees (45°) from the longitudinal direction of the inseam panel insert 500, and the width of the inseam panel insert 500 at the crotch location 540 may be from about fifty percent (50%) to about one-hundred percent (100%) more narrow than the width of the inseam panel insert 500 at the right knee location 532 or left knee location 533.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the versions contained therein.

What is claimed is:

1. A pair of trousers comprising:

a left trouser leg comprising at least one fabric piece having a left trouser leg fabric piece edge, the left trouser leg further comprising a left trouser leg bottom;

a right trouser leg comprising at least one fabric piece having a right trouser leg fabric piece edge, the right trouser leg further comprising a right trouser leg bottom;

a crotch;

an inseam panel at least partially disposed within the crotch and comprising a fabric piece having a left inseam panel edge and a right inseam panel edge wherein the inseam panel extends from the crotch to the left trouser leg bottom and to the right trouser leg bottom;

wherein the left inseam panel edge adjoins the left trouser leg fabric piece edge beginning in the crotch and extends to the left trouser leg bottom and wherein the right inseam panel edge adjoins the right trouser leg fabric piece edge beginning in the crotch and extends to the right trouser leg bottom;

wherein the inseam panel comprises at least two separated increased width portions separated by a narrower width portion, wherein the separated increased width portions are both wider than the narrower width portion that separates the separated increased width portions, wherein the separated increased width portions are located at positions away from the crotch and from the right trouser leg bottom and the left trouser leg bottom, and wherein one of the at least two separated increased width portions is disposed on the right trouser leg and one of the at least two separated increased width portions is disposed on the left trouser leg; and wherein the inseam panel comprises at least one additional separated increased width portion that is separated from one of the at least two separated increased width portions by an additional narrower width portion that has a width different than a width of one of the at least two separated increased width portions.

2. The trousers of claim 1 wherein the at least one additional separated increased width portion comprises at least two additional separated increased width portions, the at least two additional separated increased width portions are separated from one another by another additional narrower width portion.

3. The trousers of claim 2 wherein the at least two additional separated increased width portions have widths that are different than a width of at least one of the two separated increased width portions.

4. The trousers of claim 1, wherein one of the at least two separated increased width portions is located closer to the crotch than to the right trouser leg bottom and one of the at least two separated increased width portions is located closer to the crotch than to the left trouser leg bottom.

5. The trousers of claim 1 further comprising a left knee area and a right knee area and wherein at least one of the at least two separated increased width portions is located proximate either the left knee area or the right knee area.

6. The trousers of claim 1 further comprising a left knee area and a right knee area and wherein one of the at least two separated increased width portions is located proximate the left knee area and wherein one of the at least two separated increased width portions is located proximate the right knee area.

7. The trousers of claim 1, wherein at least one of the at least two separated increased width portions is located closer to the crotch than to the right trouser leg bottom or the left trouser leg bottom.

8. The trousers of claim 1, wherein the inseam panel is formed of an elastic or stretchable material.

9. The trousers of claim 1 wherein the at least two separated increased width portions have the same width.

10. The trousers of claim 1 wherein the at least one additional separated increased width portion and the at least two separated increased portions have the same width.

11. The trousers of claim 1 wherein the at least one additional separated increased width portion is located at a position away from the crotch and from the right trouser leg bottom and the left trouser leg bottom.

12. The trousers of claim 1 wherein the at least one additional separated increased width portion has a width that is different than the width of at least one of the at least two separated increased width portions.

* * * * *